US005673010A

United States Patent [19]

Dusseux et al.

[11] Patent Number: 5,673,010

[45] Date of Patent: Sep. 30, 1997

[54] POWER DISTRIBUTOR SYSTEM AND POWER DISTRIBUTOR FOR MICROWAVE SIGNALS HAVING RECURRING HIERARCHICAL STRUCTURE OF DISTRIBUTOR ELEMENTS AND COUPLER ELEMENTS

[75] Inventors: Thierry Dusseux, Tournefeuille; Jean-Marie Saury, Toulouse; Philippe Brunet, Muret; Mohamed Masmoudi, Toulouse, all of France

[73] Assignee: Alcatel Espace, Nanterre Cedex, France

[21] Appl. No.: 358,361

[22] Filed: Dec. 19, 1994

[30] Foreign Application Priority Data

Dec. 20, 1993 [FR] France ..... 93 15299

[51] Int. Cl.[6] ..... H01P 5/12

[52] U.S. Cl. ..... 333/109; 333/110; 342/373

[58] Field of Search ..... 333/1, 4, 109, 333/110, 100, 111, 113, 114; 342/368, 373

[56] References Cited

U.S. PATENT DOCUMENTS

| | | | |
|---|---|---|---|
| 4,231,040 | 10/1980 | Walker | 343/100 SA |
| 4,323,863 | 4/1982 | Weber | 333/109 |
| 4,514,699 | 4/1985 | Kariatsumari et al. | 330/53 |
| 4,638,317 | 1/1987 | Evans | 342/373 |
| 5,105,170 | 4/1992 | Joshi | 333/113 |

FOREIGN PATENT DOCUMENTS

| | | |
|---|---|---|
| 2732627A1 | 2/1979 | Germany . |
| 1559974 | 1/1980 | United Kingdom . |

*Primary Examiner*—Benny Lee
*Assistant Examiner*—David Vu
*Attorney, Agent, or Firm*—Sughrue, Mion, Zinn, Macpeak & Seas

[57] ABSTRACT

A power distributor for microwave signals has n inputs and n outputs, n/2 coupler elements, four power distributor elements each having n/2 inputs and n/2 outputs. The inputs of the first and third distributor elements correspond to respective inputs of the distributor and the outputs of the second and fourth distributor elements correspond to respective outputs of the distributor. The outputs of the first distributor element are connected to respective first inputs of the couplers and the outputs of the third distributor element are connected to respective second inputs of the couplers. The inputs of the second distributor element are connected to respective first outputs of the couplers and the inputs of the fourth distributor element are connected to respective second outputs of the couplers.

14 Claims, 9 Drawing Sheets

POWER DISTRIBUTOR SYSTEM AND POWER DISTRIBUTOR FOR MICROWAVE SIGNALS HAVING RECURRING HIERARCHICAL STRUCTURE OF DISTRIBUTOR ELEMENTS AND COUPLER ELEMENTS

BACKGROUND OF THE INVENTION

1. Field of the Invention

The invention concerns a power distributor for microwave signals having p signal inputs and n signal outputs (n and p having any values) and a set of coupling elements connecting the p inputs to the n outputs in order to distribute the power of the input signals to the n outputs in accordance with any orthogonal amplitude law.

A distributor of this kind is intended primarily for active or passive multisource antennas where there is a requirement to minimize power losses.

2. Description of the Prior Art

The prior art includes several types of power distributor for microwave signals.

FIG. 1 shows a power distributor in which the set of coupling elements is in the form of a Butler matrix with eight inputs E1–E8 and eight outputs S1–S8. In the Butler matrix the coupling elements 1 are 3 dB equi-amplitude couplers. This matrix includes phase-shifting elements for which the phase-shift value is a multiple of ±45°. The Butler matrix has the drawback of being restricted to equi-amplitude laws for a number of outputs which is equal to a power of 2.

FIG. 2 shows a Blass matrix having any number of inputs E and outputs S (the number of inputs is equal to or less than the number of outputs). However, this matrix suffers from power losses because the coupling elements 1 of the top row of the matrix have an output connected to a matched load.

FIG. 3 shows a Blass matrix modified to avoid the power losses. However, a Blass matrix modified in this way has the drawback of being asymmetrical. The number of coupling elements 1 connecting an input E to an output S varies according to the position of the input and the output. It is then necessary to provide lines of differing length according to the paths taken by the input signals, which severely complicates the implementation of the power distributor.

An object of the invention is to remedy the above drawbacks by proposing a distributor that is simple to implement and which can distribute the power of the input signals to the outputs in accordance with any amplitude law. The term "amplitude law" means a mathematical relationship which expresses the amplitude in terms of another variable, such as spatial position along one or more dimensions. An "equi-amplitude law" is an amplitude law in which the amplitudes are equal. This is the trivial case of an amplitude law, wherein the amplitude does not depend on the other variable, but, rather, is constant no matter what the value of the variable. If an amplitude law is chosen having a large number of null amplitudes, the distributor behaves as a switching matrix. If an equi-amplitude law is chosen, the advantages of the invention over the prior art (Butler matrix) are not achieved.

SUMMARY OF THE INVENTION

The invention consists in a power distributor for microwave signals according to claim 1 for an even number of inputs and outputs and a power distributor for microwave signals according to claim 2 for an odd number of inputs and outputs. Specific embodiments of the invention for distributors with p inputs and n outputs are defined in claims 3 to 6. An advantageous embodiment of the invention consists in a distributor whose elements define a construction having a geometrical shape which repeats recurrently within said elements to produce elements in the form of orthogonal coupler elements or dividers that are simple to implement.

The invention is described In detail below with reference to the drawings.

DETAILED DESCRIPTION OF THE PREFERRED EMBODIMENTS

All these various embodiments of power distributor in accordance with the invention include an interface set of couplers substantially centrally disposed in the distributor relative to the inputs and the outputs of the distributor. This set of couplers receives input signals on cross-connected lines and/or supplies signals on cross-connected lines. The cross-connection of the input and/or output lines of the interface set of couplers defines a degree of symmetry of construction of the distributor relative to an axis defined by the direction of propagation of signals in the distributor. Signals entering the interface set of couplers pass through a number of couplers differing by at most one coupler.

Figure 1:
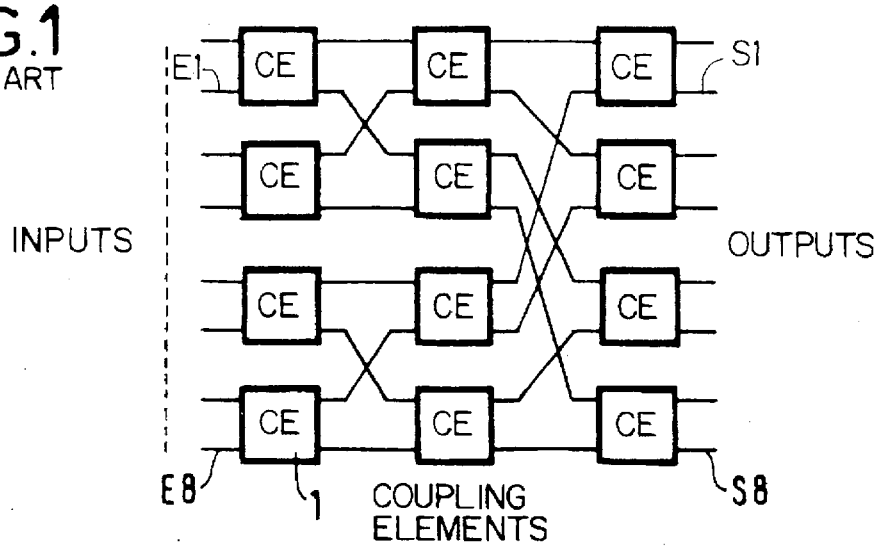
FIG.1 PRIOR ART
FIG. 1 shows a Butler matrix.
Figure 2:
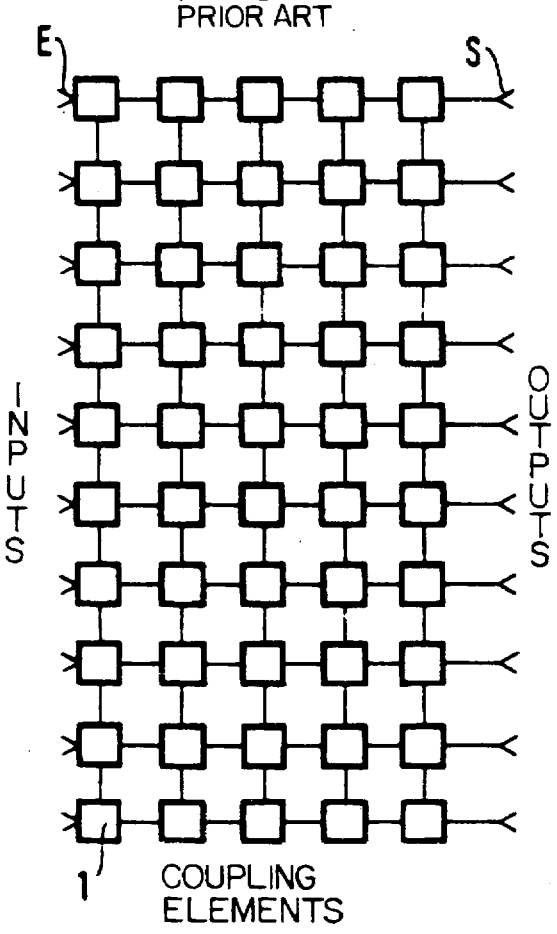
FIG.2 PRIOR ART
FIG. 2 shows a Blass matrix.
Figure 3:
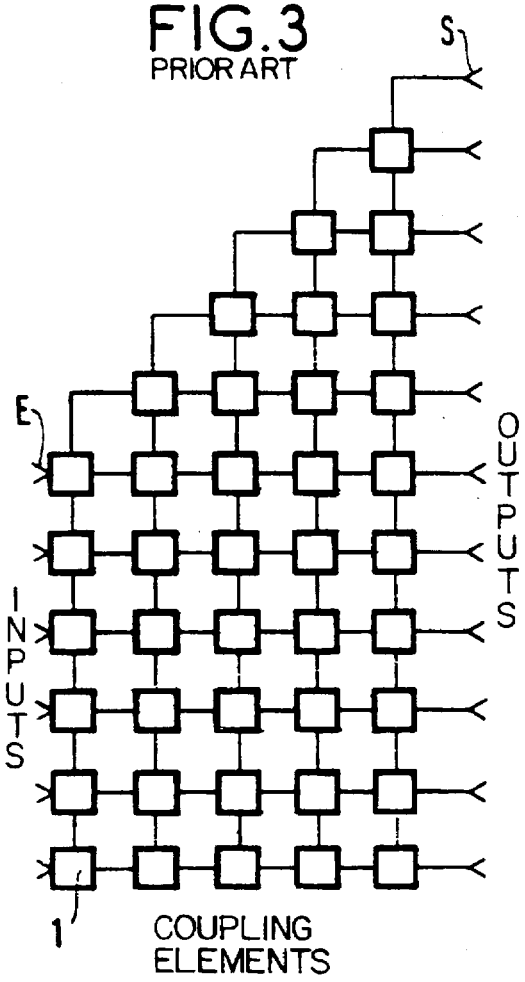
FIG.3 PRIOR ART
FIG. 3 shows a modified Blass matrix.
Figure 4:
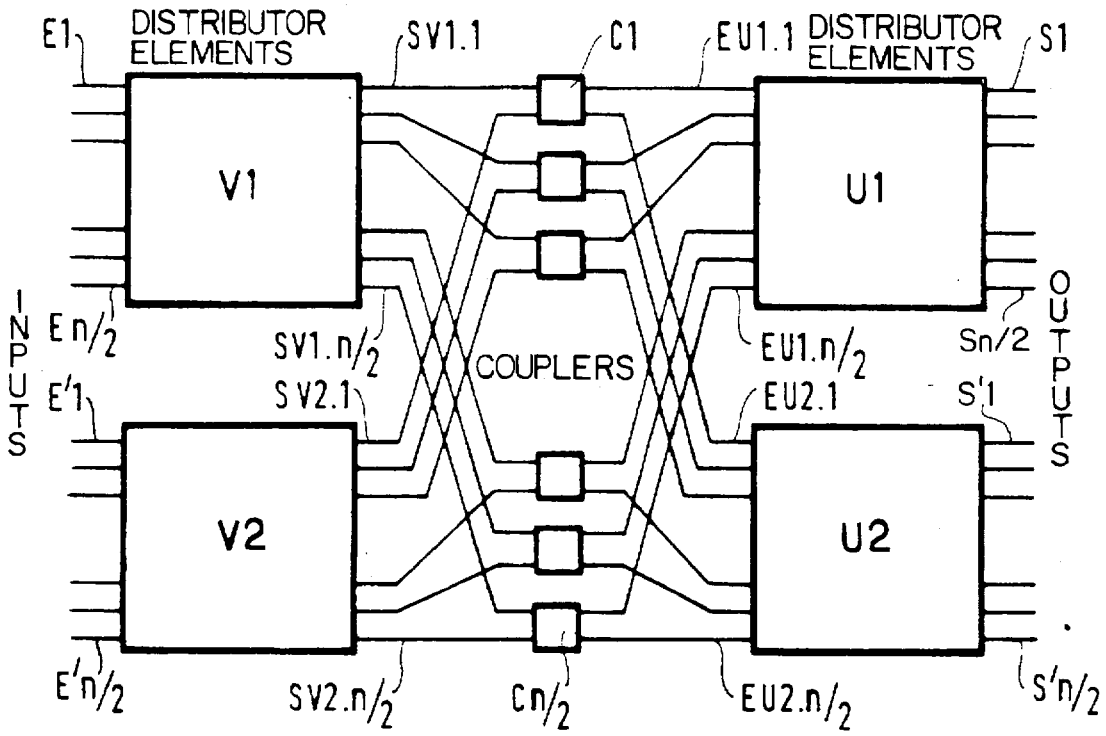
FIG. 4 shows a distributor with n inputs and n outputs where n is even.

The power distributor in FIG. 4 has n signal inputs and n signal outputs where n is even.

The n inputs and the n outputs are interconnected by a set of coupling elements.

This set comprises n/2 couplers C1–Cn2 each having two inputs and two orthogonal outputs. These couplers are conventional. It also comprises four square orthogonal distributor elements V1, U1, V2, U2 each of which has n/2 inputs and n/2 outputs.

Referring to FIG. 4, the inputs E1–En/2, E'1–E'n/2 of the distributor elements V1, V2 are the inputs of the distributor and the outputs S1–Sn/2, S'1–S'n/2 of the distributor elements U1, U2 are the outputs of the same distributor.

The outputs SV1.1–SV1.n/2 of the distributor element V1 are connected to respective first inputs of the n/2 couplers C1–Cn/2.

The outputs SV2.1–SV2.n/2 of the distributor element V2 are connected to respective second inputs of the n/2 couplers C1–C/2.

The inputs EU1.1–EU1.n/2 of the distributor element U1 are connected to respective first outputs of the n/2 couplers C1–Cn/2.

Finally, the inputs EU2.1–EU2.n/2 of the distributor element U2 are connected to respective second outputs of the n/2 couplers C1–Cn/2.

Figure 5:
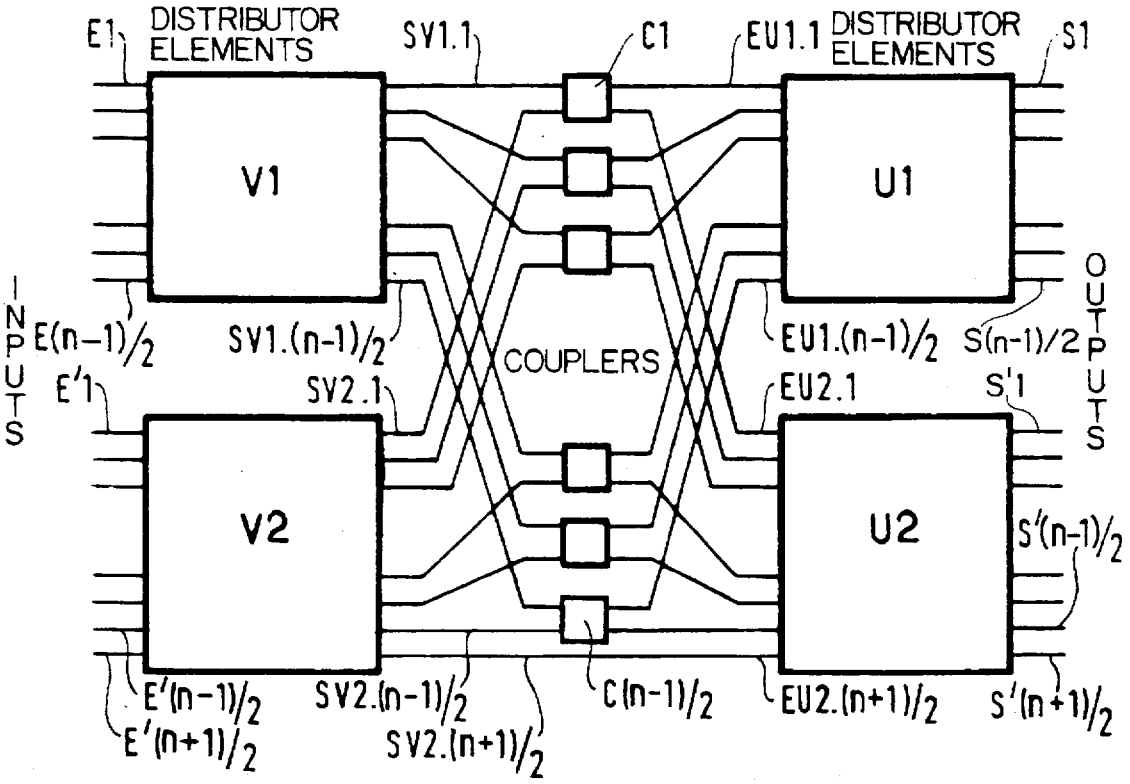
FIG. 5 shows a distributor with n inputs and n outputs where n is odd.

Referring to FIG. 5, if n is odd, the configuration of the distributor is identical to that of FIG. 4 except that an output SV2.(n+1)/2 of the distributor element V2 is connected direct to the input EU2.(n+1)/2 of the distributor element U2. The number of couplers is equal to (n−1)/2.

Figure 6:
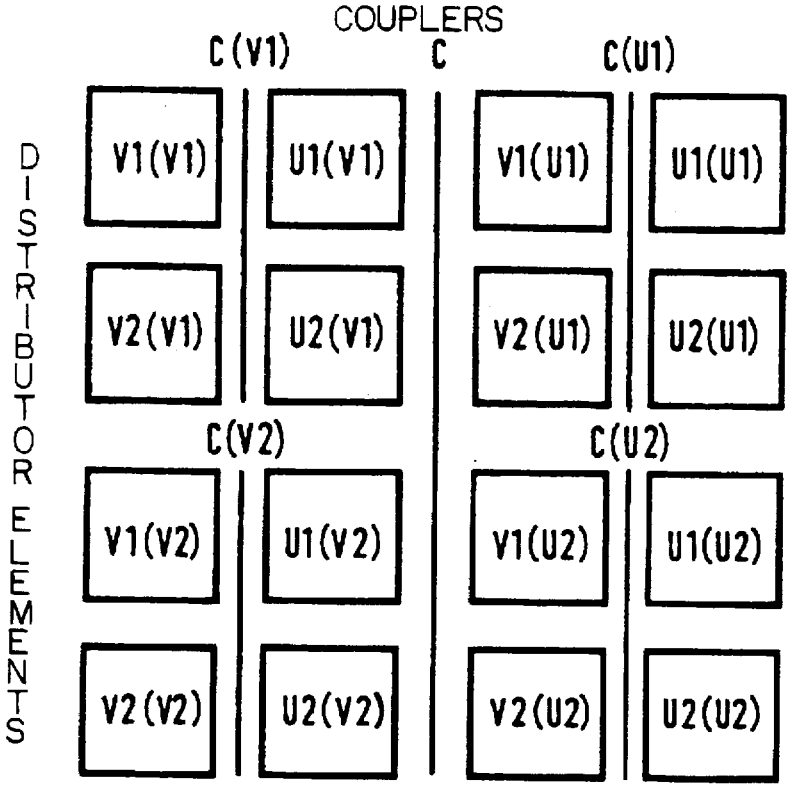
FIG. 6 shows the technique for constructing the distributor from FIG. 4 or FIG. 5.

The distributors shown in FIGS. 4 and 5 are square. In these distributors the distributor elements V1, V2, U1, U2 connected to the couplers C1–Cn/2 or C1–C(n−1)/2 define a geometrical shape, i.e. a wiring schematic. This geometric shape is repeated recurrently inside each distributor element as shown in FIG. 6 for as long as the number of inputs or outputs of the distributor elements V1, V2, U1, U2 at the deepest level of recurrence is greater than 2. At the last level of recurrence there are distributor elements with two inputs and two outputs, i.e. coupler elements that are easy to implement. It must be understood that fabrication of the distributor starts with determination of the wiring schematic corresponding to the deepest level of recurrence.

Figure 7:
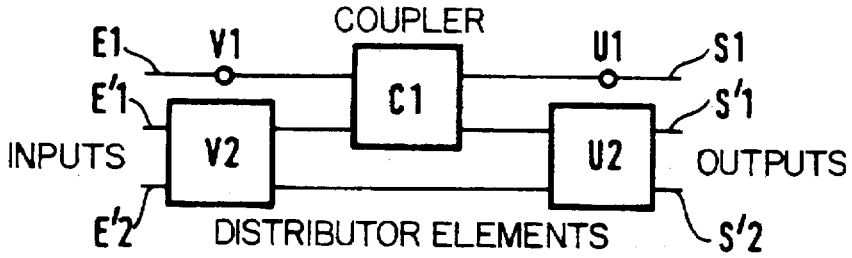
FIG. 7 shows a distributor with three inputs and three outputs.

FIG. 7 shows a power distributor with three inputs E1, E'1–E'2 and three outputs S1, S'1–S'2. In this case the distributor elements V1, U1 are merely phase-shifters.

Figure 8:
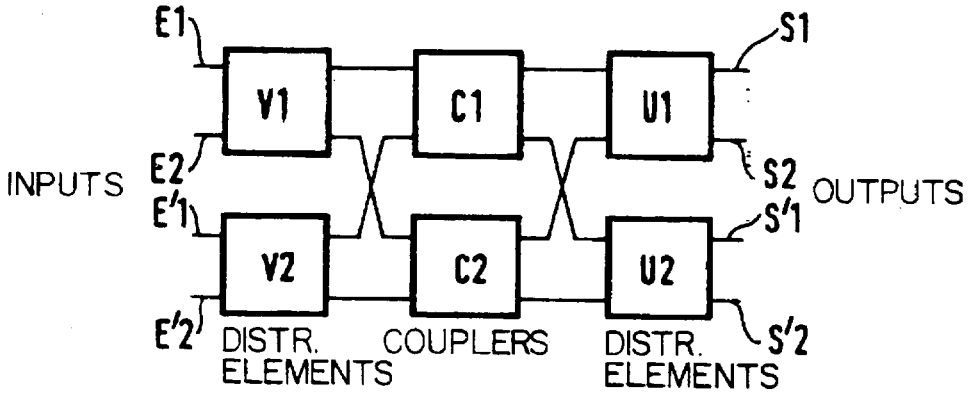
FIG. 8 shows a distributor with four inputs and four outputs.

FIG. 8 shows a power distributor with four inputs E1–E2, E'1–E'2 and four outputs S1–S2, S'1–S'2. In this case the four distributor elements V1, V2, U1, U2 are coupler elements with two inputs and two outputs which are simple to implement.

Figure 9:
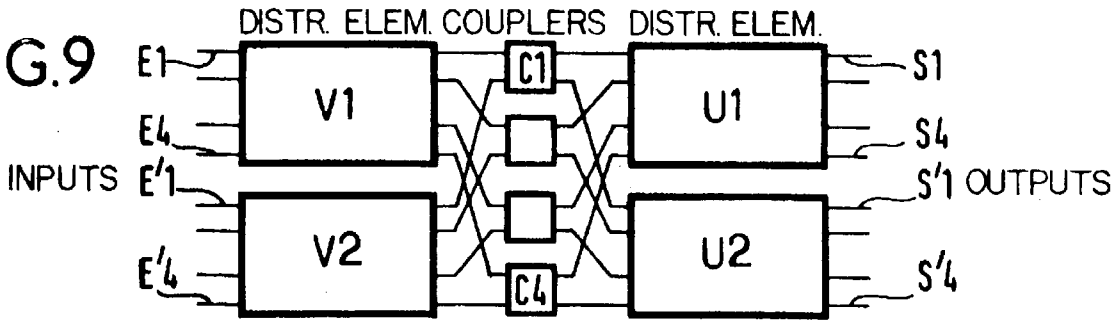
FIG. 9 shows the general structure of a distributor with eight inputs and eight outputs.
Figure 10:
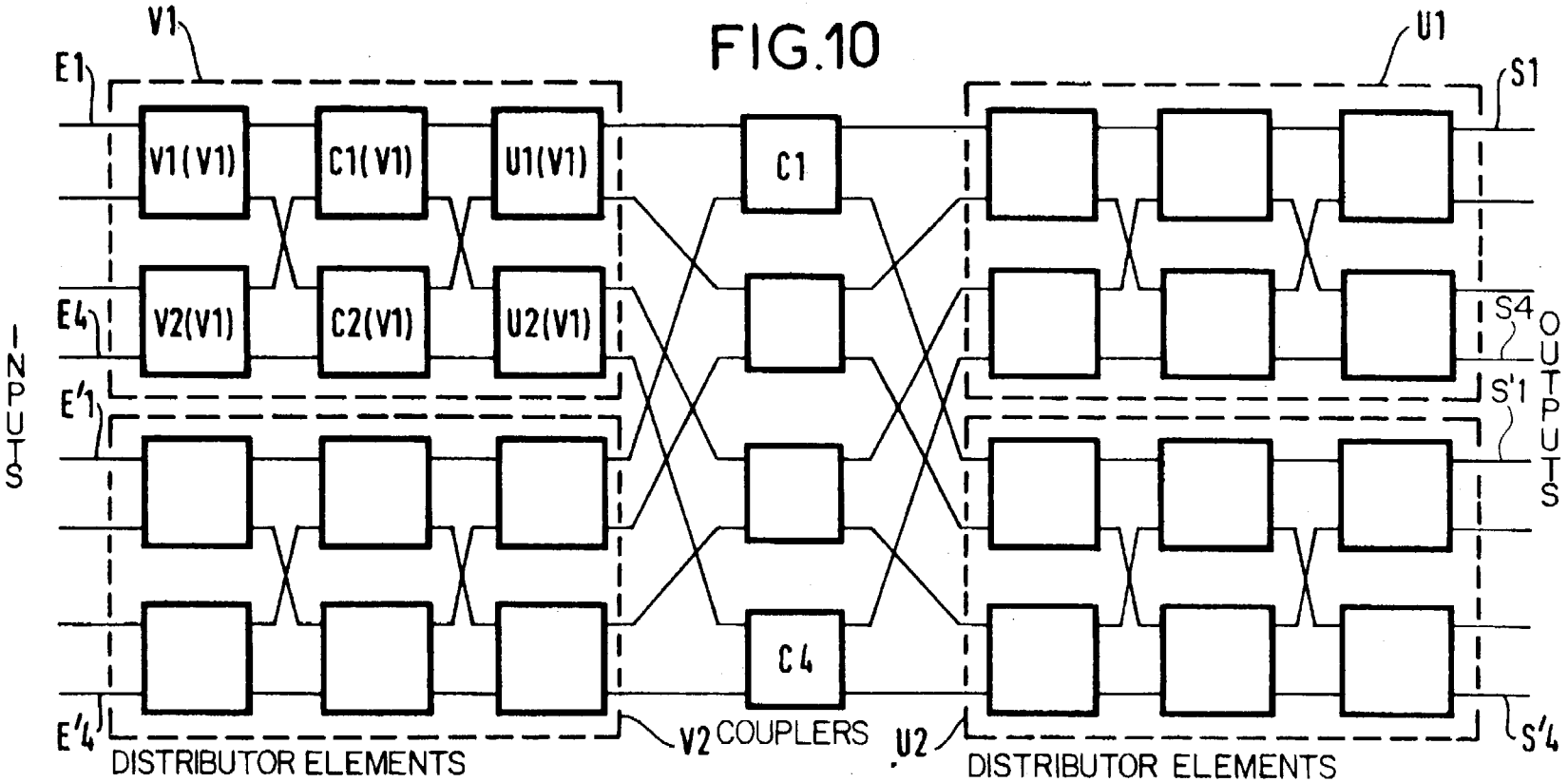
FIG. 10 shows the detailed structure of a distributor with eight inputs and eight outputs.

FIG. 9 shows a power distributor with eight inputs E1–E4, E'1–E'4 and eight outputs S1–S4, S'1–S'4. This distributor comprises four distributor elements V1, V2, U1, U2 and four couplers. Each distributor element (element V1, for example) comprises four distributor elements V1(V1), V2(V1), U1(V1), U2(V1) interconnected by two couplers C1(V1), C2(V1) as shown in FIG. 10.

The method of constructing distributor elements as described above is easily generalized for distributor elements having a number of inputs and outputs greater than 8. As a general rule, the number of couplers c(n) needed to implement a power distributor having n inputs and n outputs, whether n is even or odd, is given by the following equation:

$$c(n)=n.(n-1)/2.$$

Compared to a Butler matrix distributor, the distributor of the invention is able to distribute the power of n input signals to n outputs, where n has any value, in accordance with any amplitude law with a minimum number of couplers given that each coupler is adjusted accordingly.

Figure 11:
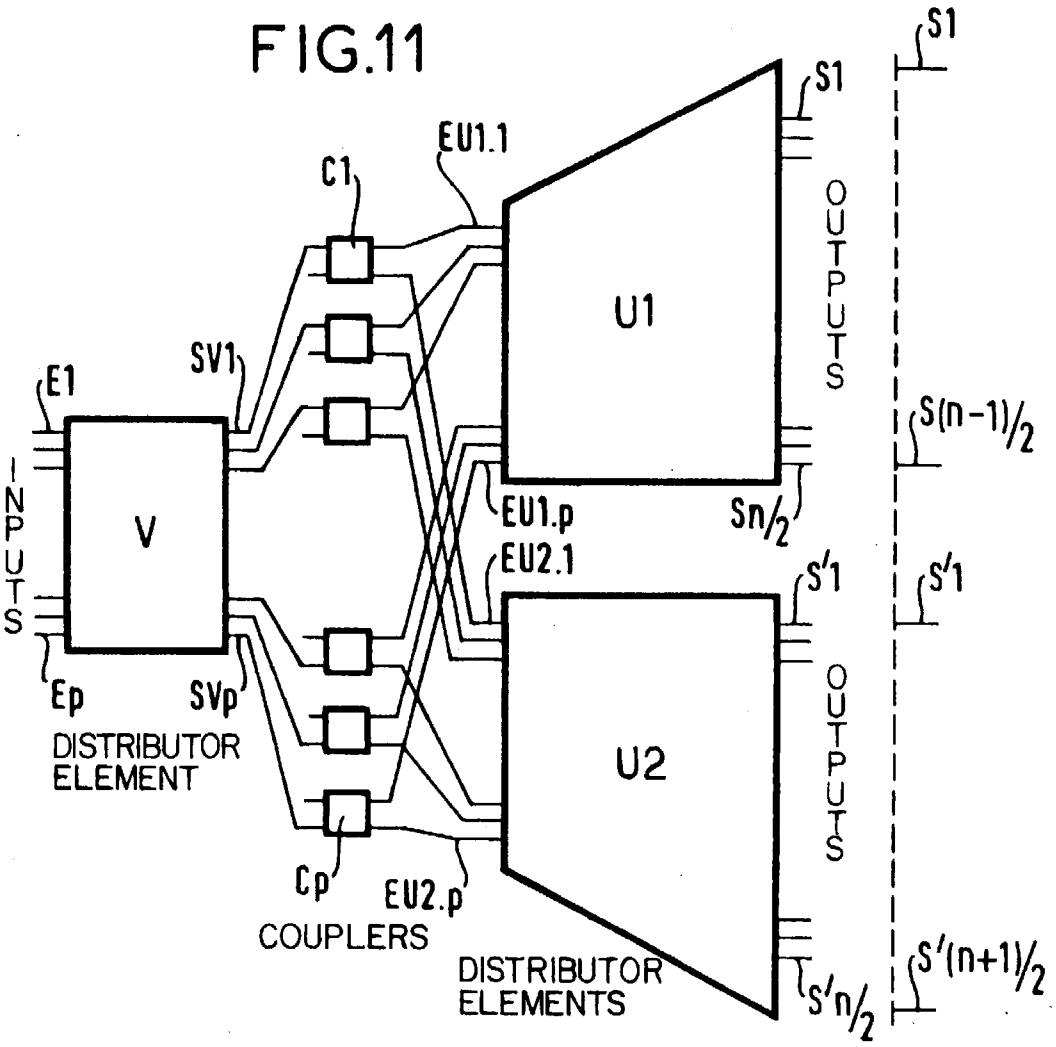
FIG. 11 shows a distributor with p inputs and n outputs with $p<n/2$.

The power distributor shown in FIG. 11 has p signal inputs E1-Ep and n signal outputs S1–Sn/2 and S'1–S'/2 where n is even and p<n/2.

It comprises firstly p couplers C1-Cp each having two inputs and two orthogonal outputs, a first distributor element V and two second distributor elements U1, U2. Each coupler C1-Cp has one input terminated at a load and in effect therefore has only input.

The p inputs E1-Ep of the distributor element V correspond to the inputs of the distributor. The distributor element V also has p outputs SV1-SVp.

The distributor elements U1-U2 each have p inputs EU1.1–EU1.p and EU2.1–EU.p, respectively. Each has /2 outputs S1–Sn/2 and S'1–S'n/2, respectively. The outputs S1–Sn/2, S'1-S'n/2 of the two distributor elements U1, U2 correspond to respective outputs of the distributor.

The outputs SV1-SVp of the distributor element V are connected to respective inputs of the p couplers C1-Cp.

The inputs E1.1–E1.p of the distributor element U1 are connected to respective first outputs of the couplers and the inputs EU2.1–EU2.p of the distributor element U2 are connected to respective second outputs of the p couplers.

If n is odd the distributor is identical to that shown in FIG. 11 except that the distributor element U1 has (n−1)/2 outputs S1–S(n−1)/2 and the distributor element U2 has (n+1)/2 outputs S'1–S'(n+1)/2 as shown in dashed line in FIG. 11.

Figure 12:
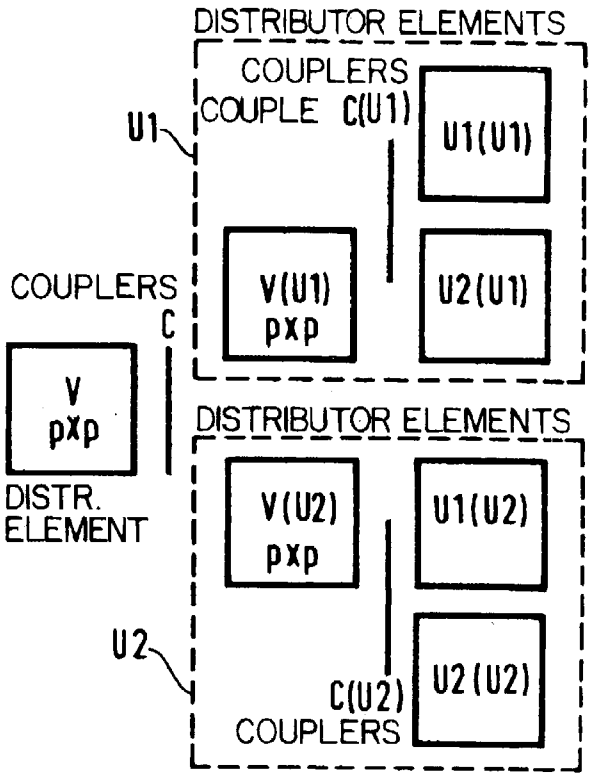
FIG. 12 shows the technique for constructing the distributor from FIG. 11.

The geometrical shape of the distributor shown in FIG. 11 is repeated recurrently in the distributor elements U1, U2 as shown in FIG. 12 for as long as the resulting distributor elements U1, U2 have, for a given level of recurrence, a number p of inputs and a number of outputs satisfying the condition p<n/2. Referring to FIG. 12, the distributor elements V(U1), U1(U1), U2(U1) constitute, at a first level of recurrence, the distributor element U1 from FIG. 11. Likewise, the distributor elements V(U2), U1(U2), U2(U2) constitute, at a first level of recurrence, the distributor element U2 from FIG. 11.

Figure 13:
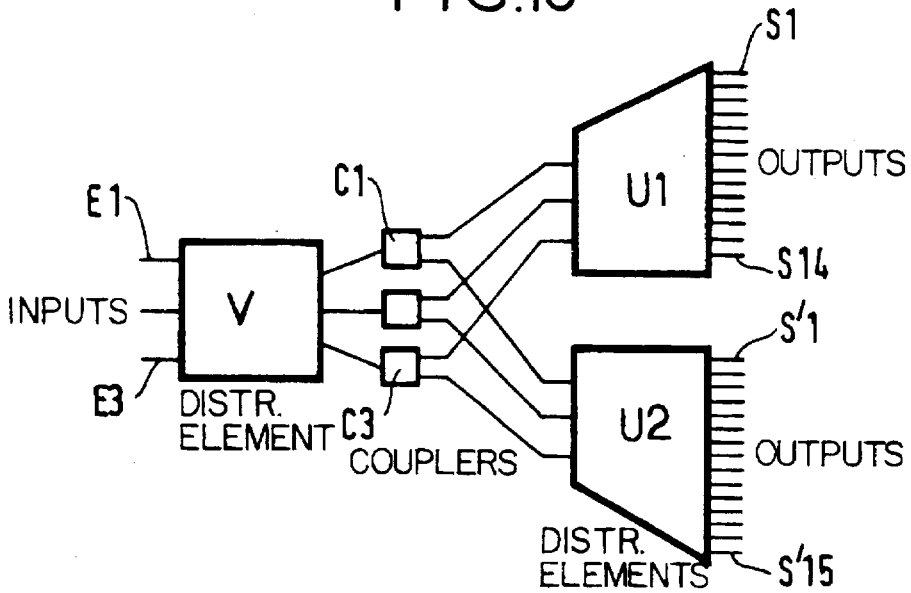
FIG. 13 shows a distributor with three inputs and outputs at a first level of construction.
Figure 14:
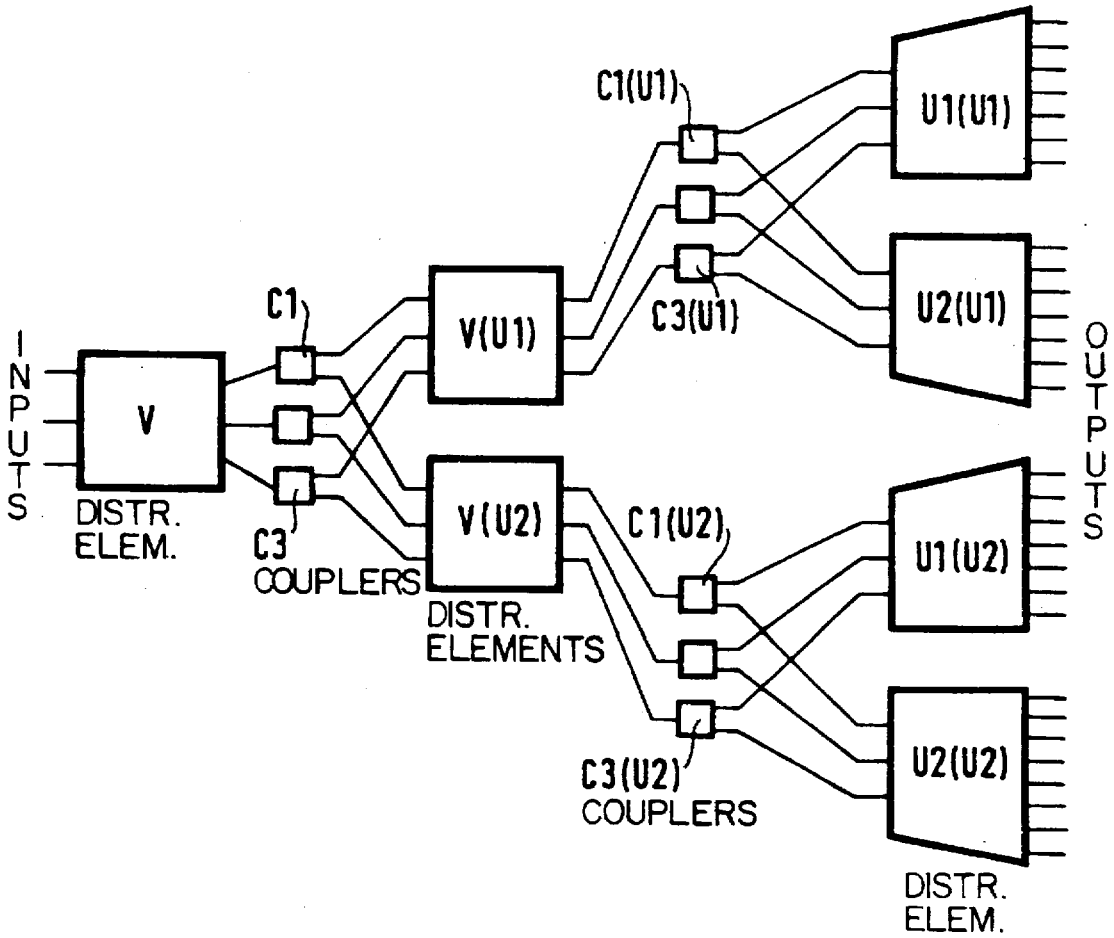
FIG. 14 shows the distributor from FIG. 13 at a second level of construction.
Figure 15:
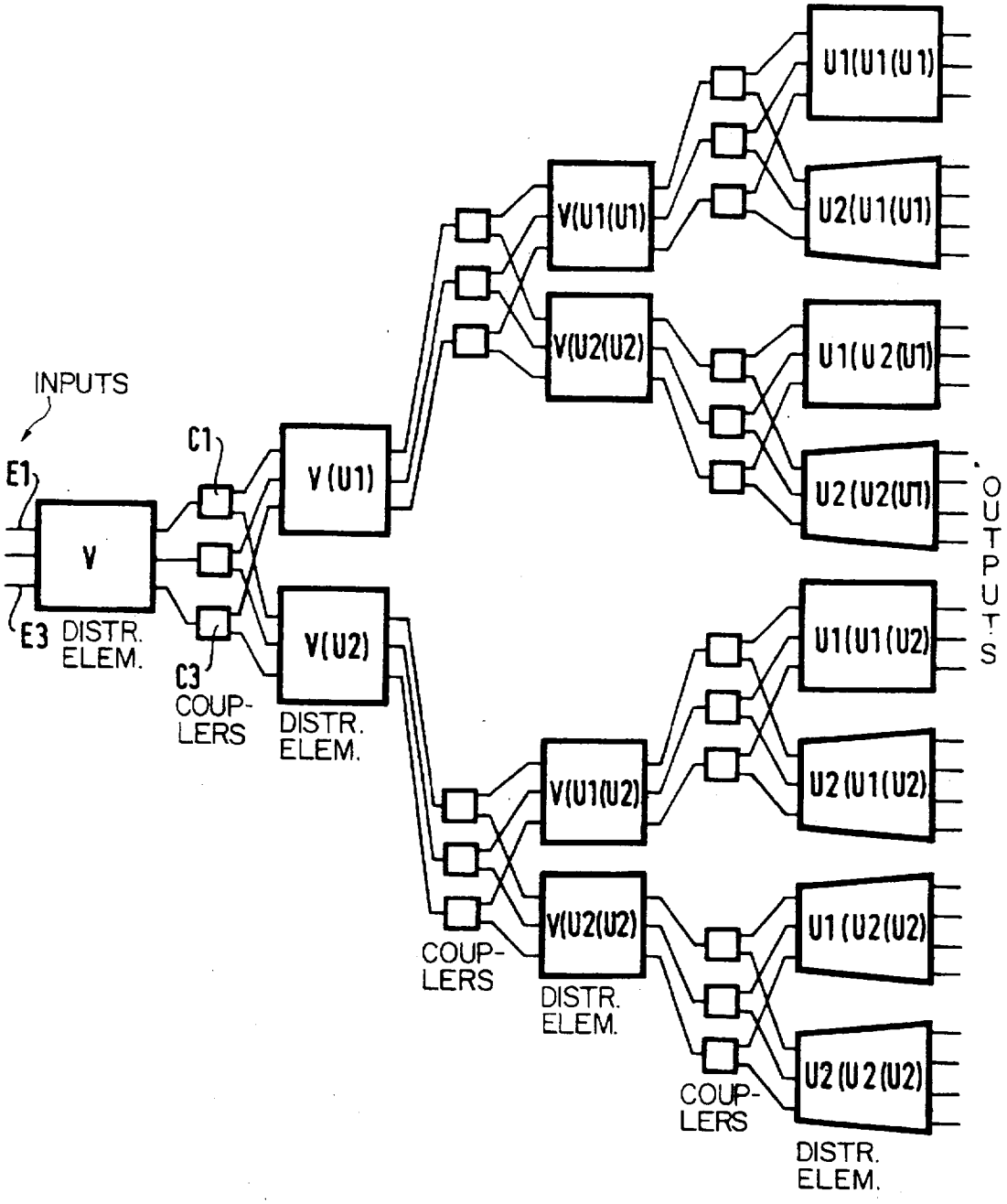
FIG. 15 shows the distributor from FIG. 13 at a third level of construction.

FIG. 13 provides a better understanding of how the final structure of the distributor having p inputs and n outputs is determined. This figure shows a power distributor with three inputs E1–E3 and 29 outputs S1–S14; S'1–S'15 and comprising three distributor elements V, U1, U2. FIG. 14 shows the same distributor for a first level of recurrence. The distributor elements U1 and U2 have been replaced by distributor elements V(U1), U1(U1), U2(U1), V(U2), U1(U2), U2(U2). FIG. 15 shows the same distributor as FIG. 14 at a second level of recurrence. The distributor elements U1(U1), U2(U1), U1(U2) and U2(U2) are replaced by distributor elements V(U1(U1)) . . . U2(U2(U2)). The final structure of the distributor is such that the distributor elements U1(U1(U1)) . . . U2(U2(U2)) are replaced by distributor elements as shown in FIG. 7 (3×3 distributor elements) or FIG. 8 (3×4 distributor elements). As a general rule, the number of couplers c(p, n) needed to implement a power distributor having p inputs and n outputs with p≦n/2, whether n is even or odd, is given by the equation:

$$c(p, n)=np-p(p+1)/2$$

When p=3 and n=29, c(3, 29) is equal to 81.

The distributor of this kind is suited to any amplitude law for a minimum number of couplers.

Figure 16:
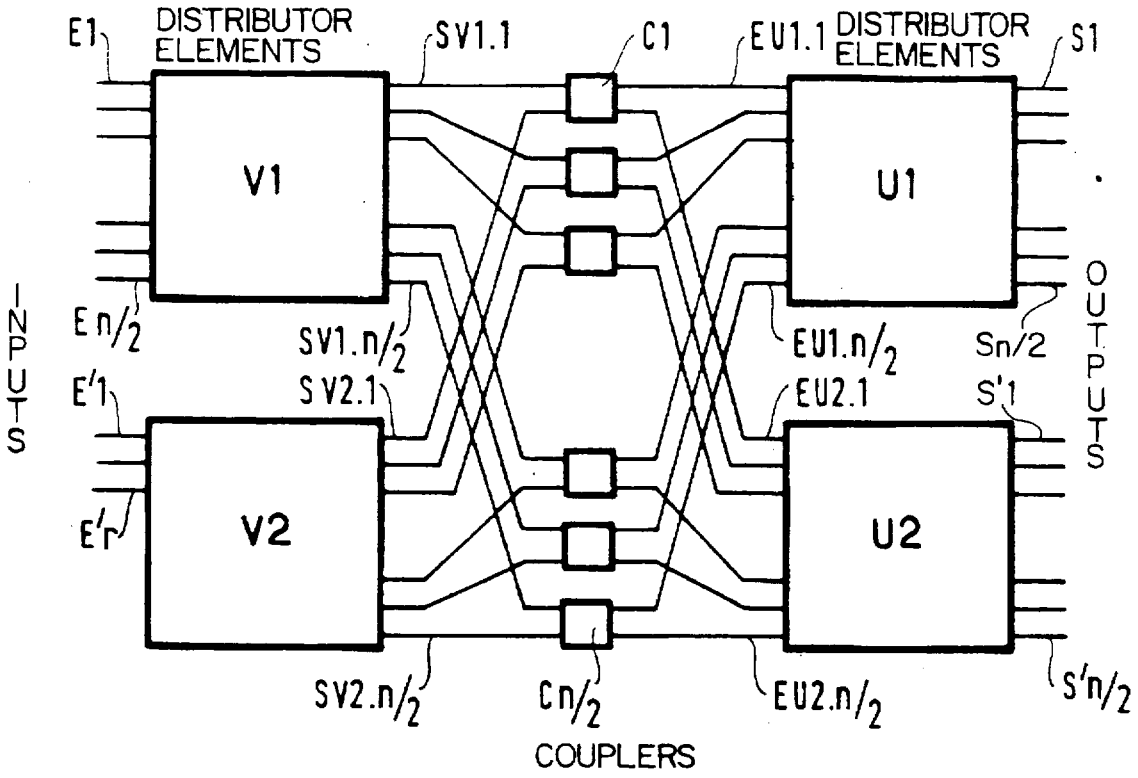
FIG. 16 shows a distributor with p inputs and n outputs with n even and $n>p>n/2$.

FIG. 16 shows a distributor with p inputs and n outputs where n is even and n>p>n/2.

It comprises n/2 coupler elements C1–Cn2 connected to four distributor elements V1, V2, U1, U2. The distributor elements V1 and U1 each have n/2 inputs and n/2 outputs. The distributor element U2 has n/2 inputs and n/2 outputs. The distributor element V2 has r inputs and n/2 outputs where r is given by the equation:

$$r=p-n/2$$

It is to be understood that distribution of the inputs between the elements V1 and V2 arises from constructing a square matrix having n inputs and n outputs, segmenting the matrix in two, assigning n/2 inputs to the distributor element V1, and eliminating the superfluous inputs from the n/2 remaining inputs assigned to the distributor element V2.

In FIG. 16 the inputs E1–En/2 and the inputs E'1-E'r of the distributor elements V1 and V2 are the inputs of the distributor. The outputs S1-Sn/2 and the outputs S'1-S'n/2 of the distributor elements U1 and U2 are the outputs of the distributor.

The outputs of the distributor elements V1, V2 and the inputs of the distributor elements U1, U2 are connected to the inputs and the outputs of the couplers C1–Cn2 as described above with reference to FIG. 4.

Figure 17:
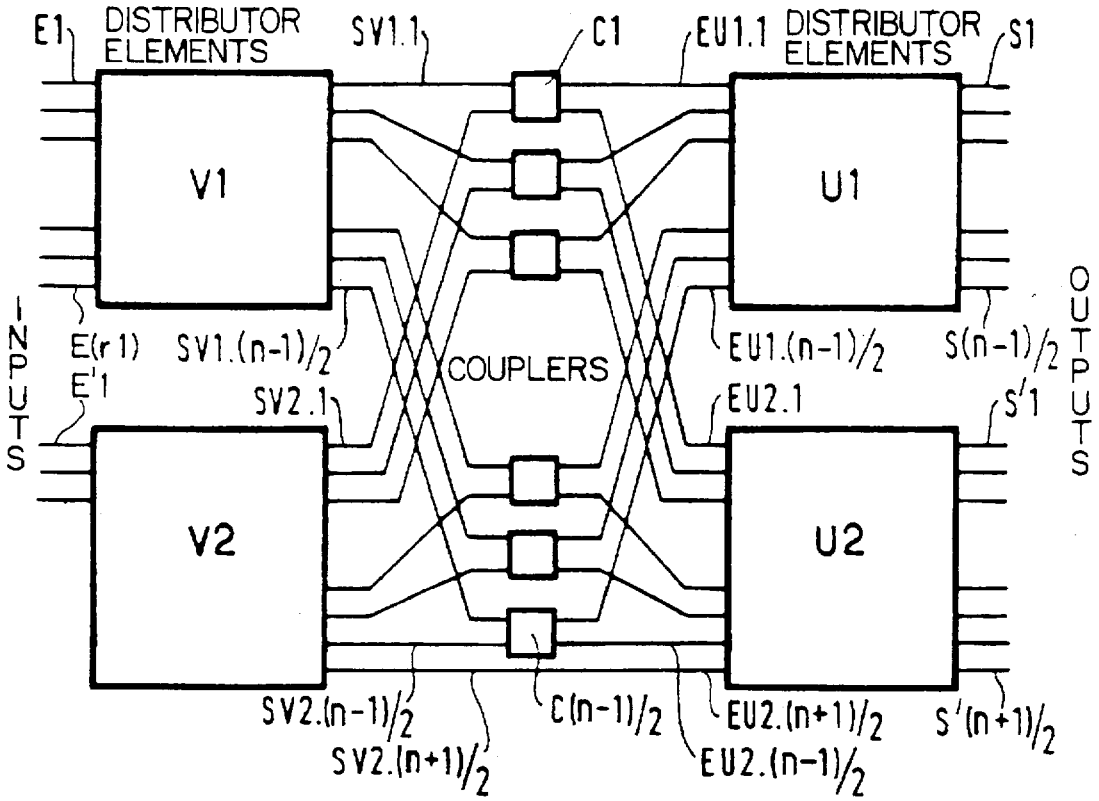
FIG. 17 shows a distributor with p inputs and n outputs with n odd and $n>p>n/2$.

In the case of a distributor as shown in FIG. 17 with p inputs and n outputs where n is odd and n>p>n/2 there are (n−1)/2 couplers and four distributor elements V1, U1, V2, U2.

The distributor elements V1 and U1 each have (n−1)/2 inputs and (n−1)/2 outputs. The distributor element U2 has (n+1)/2 inputs and (n+1)/2 outputs. The distributor element V2 has r inputs and (n+1)/2 outputs where r is given by the equation:

$$r=p-(n-1)/2$$

The (n−1)/2 inputs E1-E(n−1)/2 of the distributor element V1 and the r inputs E'1-E'r of the distributor element V2 are the inputs of the distributor. The (n−1)/2 outputs S1-S(n−1)/2 of the distributor element U1 and the (n+1)/2 outputs S'1-S'(n+1)/2 of the distributor element U2 are the outputs of the distributor.

The outputs of the distributor elements V1, V2 and the inputs of the distributor elements U1, U2 are connected to the inputs and the outputs of the couplers C1-C(n−1)/2 couplers as described above with reference to FIG. 5.

The distributor elements V1, U1, V2, U2 from figure 16 and FIG. 17 comprise distributor elements which repeat a geometrical shape as described above.

Each distributor element V1, U1 comprises distributor elements V1, U2, V2, U2 as described above with reference to FIG. 4 in the case of a distributor with n inputs and n outputs where n is even. The distributor element U2 comprises distributor elements V1, U1, V2, U2 as described above with reference to FIG. 5 in the case of a distributor with n inputs and n outputs where n is odd.

There are two possibilities with regard to the distributor element V2 from FIG. 16 or FIG. 17. If for a given level of recurrence the number p' of inputs and the number n' of outputs of the distributor element V2 satisfy the condition p'>n'/2, then the geometrical shape of the construction, defined by the distributor elements V1, U1, V2, U2 connected to the couplers as shown in FIG. 16 or FIG. 17 according to whether p' is even or odd, is repeated within the distributor element V2. Otherwise (p'≦n/2), the distributor element V2 is identical to the distributor shown in FIG. 11.

Figure 18:
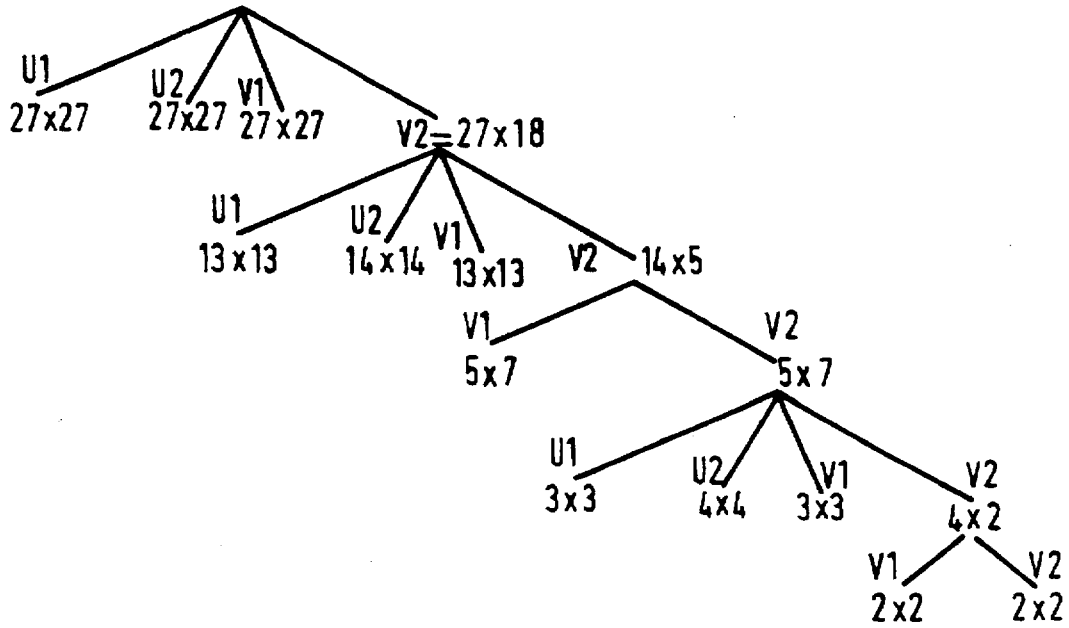
FIG. 18 shows the technique for constructing the distributor from FIG. 16 or FIG. 17.

FIG. 18 shows the levels of recurrence for the construction of a distributor having 45 inputs and 54 outputs. Initially the distributor comprises four distributor elements V1 (27 outputs, 27 inputs), U1 (27 outputs, 27 inputs), V2 (27 outputs, 18 inputs) and U2 (27 outputs, 27 inputs). The distributor element V2 comprises four distributor elements U1 (13, 13), U2 (14, 14), V2 (13, 13) and V2 (14, 5), and so on. It is to be understood that the distributor elements V1, U1, U2 comprise couplers such as those shown in FIGS. 4 and 5.

The structure of the distributor is easily simplified in the following cases.

If n−p=1, p being the number of inputs and n the number of outputs of the distributor, it is sufficient to eliminate any input of the distributor designed as described with reference to FIG. 4 or FIG. 5, i.e. to terminate it at a load. In this case the number of coupler elements constituting the distributor is given by the equation:

$$c(n-1, n)=c(n, n)$$

If n−p=2, it is sufficient to eliminate two inputs of the distributor designed as described with reference to FIG. 4 or FIG. 5. This eliminates a coupler element and the number of coupler elements constituting the distributor is therefore given by the equation:

$$c(n-2, n)=c(n, n)-c(2, 2)=c(n, n)-1$$

The couplers must of course be suited to the amplitude law chosen.

It is also necessary to provide phase-shifters at each connection or link between two coupler elements. These phase-shifters can be fixed or variable. For a distributor having n inputs and n outputs there are n (n+1)/2 phase-shifters. For a distributor having p inputs and n outputs there are np−p(p−1)/2 phase-shifters.

Couplers having coupling factors close to 1 or 0 are replaced by two direct links, crossed or uncrossed, or by a direct link and a load, which further simplifies the structure of the power distributor. It is to be understood that the number of couplers eliminated can be increased at the price of accepting a greater error in the approximation of the amplitude law of the distributor. Once the simplification has been applied, the coupling and phase-shift values can easily be further adjusted to suit the application of the distributor. Consequently, for a given accuracy of the distribution law, it is possible to increase the number of couplers to be eliminated so that couplers that are more difficult to implement can be eliminated.

If a coupler has only one input that is actually used (the other being terminated at a load), it can be replaced by a power splitter, which simplifies the implementation of the distributor.

There is claimed:

1. Power distributor for microwave signals comprising n signal inputs and n signal outputs where n is even and greater than or equal to 4 and a set of coupler elements connecting said n inputs to said n outputs in order to distribute the power of the input signals to said n outputs according to any amplitude law which is not an equi-amplitude law, said set of coupler elements comprising n/2 coupler elements each having two inputs and two outputs, first, second, third and fourth orthogonal power distributor elements each having n/2 inputs and n/2 outputs, the inputs of said first and third orthogonal power distributor elements corresponding to respective inputs of said power distributor for microwave signals and the outputs of said second and fourth orthogonal power distributor elements corresponding to respective outputs of said power distributor for microwave signals, the outputs of said first orthogonal power distributor element being connected to respective first inputs of said coupler elements and the outputs of said third orthogonal power distributor element being connected to respective second inputs of said coupler elements, inputs of said second orthogonal power distributor element being connected to respective first outputs of said coupler elements and the inputs of said fourth orthogonal power distributor element being connected to second outputs of said coupler elements.

2. Power distributor for microwave signals having n signal inputs and n signal outputs where n is odd and greater than or equal to 3 and a set of coupler elements connecting said n inputs to said n outputs in order to distribute the power of the input signals to said n outputs according to any amplitude law which is not an equi-amplitude law, said set of coupler elements comprising (n−1)/2 coupler elements each having two inputs and two outputs, first, second, third and fourth orthogonal power distributor elements, of which the first and the second each have (n−1)/2 inputs and (n−1)/2 outputs and the third and fourth each have (n+1)/2 inputs and (n+1)/2 outputs, the inputs of said first and third orthogonal power distributor elements corresponding to respective inputs of said power distributor for microwave signals and the outputs of said second and fourth orthogonal power distributor elements corresponding to respective outputs of said power distributor for microwave signals, the outputs of said first orthogonal power distributor element being connected to respective first inputs of said coupler elements and the outputs of said third orthogonal power distributor element, with the exception of one output, being connected to respective second inputs of said coupler elements, the inputs of said second orthogonal power distributor element being connected to respective first outputs of said coupler elements and the inputs of said fourth orthogonal power distributor element, with the exception of one input, being connected to respective second outputs of said coupler elements, said output of said third orthogonal power distributor element not connected to a coupler element being connected direct to said input of said fourth orthogonal power distributor element not connected to a coupler element.

3. Power distributor for microwave signals having p signal inputs and n signal outputs where $2 \leqq p \leqq n/2$ and n is even and greater than or equal to 4, and a set of coupler elements connecting said p inputs to said n outputs to distribute the power of the input signals to said n outputs according to any amplitude law, wherein said set of coupler elements comprises p coupler elements each having an input and two outputs, a first orthogonal power distributor element having p inputs and p outputs, second and third orthogonal power distributor elements each having p inputs and n/2 outputs, the inputs of said first orthogonal power distributor element corresponding to respective inputs of said power distributor for microwave signals, the outputs of said second and third orthogonal power distributor elements corresponding to respective outputs of said power distributor for microwave signals, the outputs of said first orthogonal power distributor element being connected to respective inputs of said coupler elements, the inputs of said second orthogonal power distributor element being connected to respective first outputs of said coupler elements, and the inputs of said third orthogonal power distributor element being connected to respective second outputs of said coupler elements.

4. Power distributor for microwave signals having p signal inputs and n signal outputs where $2 \leqq p \leqq (n-1)/2$ and where n is odd and greater than or equal to 5, and a set of coupler elements connecting said p inputs to said n outputs to distribute the power of the input signals to said n outputs in accordance with any amplitude law, wherein said set of coupler elements comprises p coupler elements each having an input and two orthogonal outputs, a first orthogonal power distributor element having p inputs and p outputs, second and third power orthogonal power distributor elements, said second orthogonal power distributor element having p inputs and (n−1)/2 outputs, said third orthogonal power distributor element having p inputs and (n+1)/2 outputs, the inputs of said first orthogonal power distributor element corresponding to respective inputs of said power distributor for microwave signals, the outputs of said second and third orthogonal power distributor elements corresponding to respective outputs of said power distributor for microwave signals, the output of said first orthogonal power distributor element being connected to respective inputs of said coupler elements, the inputs of said second orthogonal power distributor element being connected to respective first outputs of said coupler elements, and the inputs of said third orthogonal power distributor element being connected to respective second outputs of said coupler elements.

5. Power distributor for microwave signals having p signal inputs and n signal outputs where $n>p>n/2$ and where n is even and greater than or equal to 4, and a set of coupler elements connecting said p inputs to said n outputs to distribute the power of the input signals to said n outputs in accordance with any amplitude law, wherein said set of coupler elements comprises n/2 coupler elements each having two inputs and two outputs, a second and a fourth orthogonal power distributor element each having n/2 inputs and n/2 outputs, a first and a third orthogonal power distributor element respectively having r1, r2 inputs where $r1+r2=p$ and n/2 outputs, the inputs of said first and third orthogonal power distributor elements corresponding to respective inputs of said power distributor for microwave signals, the outputs of said second and fourth orthogonal power distributor elements corresponding to respective outputs of said power distributor for microwave signals, the outputs of said first orthogonal power distributor element being connected to respective first inputs of said coupler elements and the outputs of said third orthogonal power distributor element being connected to respective second inputs of said coupler elements, the inputs of said third orthogonal power distributor element being connected to respective first outputs of said coupler elements and the inputs of said fourth orthogonal power distributor element being connected to respective second outputs of said coupler elements.

6. Power distributor for microwave signals having p signal inputs and n signal outputs where $n>p>(n-1)/2$ and where n is odd and greater than or equal to 3, and a set of coupler elements connecting said p inputs to said n outputs to distribute the power of the input signals to said n outputs in accordance with any amplitude law, wherein said set of coupler elements comprises (n−1)/2 coupler elements each having two inputs and two outputs, a first and a second orthogonal power distributor element having r, (n−1)/2 inputs (where $r \leqq (n-1)/2$) and (n−1) /2 outputs, respectively, a third and a fourth orthogonal power distributor element, said third orthogonal power distributor element having r2 inputs (where $r1+r2=p$) and (n+1)/2 outputs, said fourth orthogonal power distributor element having (n+1)/2 inputs and (n+1)/2 outputs, the inputs of said first and third orthogonal power distributor elements corresponding to respective inputs of said power distributor for microwave signals, the outputs of said second and fourth orthogonal power distributor elements corresponding to respective outputs of said power distributor for microwave signals, the outputs of said first orthogonal power distributor element being connected to respective first inputs of said coupler elements and the outputs of said third orthogonal power distributor element, with the exception of one output, being connected to respective second inputs of said coupler elements, the inputs of said second orthogonal power distributor element being connected to respective first outputs of said coupler elements and the inputs of said fourth orthogonal power distributor element, with the exception of one input, being connected to respective second outputs of said coupler elements, said output of said third orthogonal power distributor element not connected to a coupler element being connected direct to said input of said fourth orthogonal power distributor element not connected to a coupler element.

7. Power distributor system for microwave signals comprising i signal inputs and i signal outputs where i is even and greater than or equal to 4 and a set of coupler elements connecting said i inputs to said i outputs in order to distribute the power of the input signals to said i outputs according to any amplitude law which is not an equi-amplitude law, said set of coupler elements comprising i/2 coupler elements each having two inputs and two outputs, first, second, third and fourth orthogonal power distributors for microwave signals each having i/2 inputs and i/2 outputs, the inputs of said first and third power distributors for microwave signals corresponding to respective inputs of said power distributor system and the outputs of said second and fourth power distributors for microwave signals corresponding to respective outputs of said power distributor system, the outputs of said first power distributor for microwave signal being connected to respective first inputs of said coupler elements and the outputs of said third power distributor for microwave signals being connected to respective second inputs of said coupler elements, inputs of said second power distributor for microwave signals being connected to respective first outputs of said coupler elements and the inputs of said fourth power distributor for microwave signals being connected to second outputs of said coupler elements;

wherein at least one of said first, second, third, and fourth power distributors for microwave signals is a power distributor for microwave signals as set forth in any of claims 1–2.

8. Power distributor system for microwave signals having i signal inputs and i signal outputs where i is odd and greater than or equal to 3 and a set of coupler elements connecting said i inputs to said i outputs in order to distribute the power of the input signals to said i outputs according to any amplitude law which is not an equi-amplitude law, said set of coupler elements comprising (i−1)/2 coupler elements each having two inputs and two outputs, first, second, third and fourth orthogonal power distributors for microwave signals, of which the first and the second each have (i−1)/2 inputs and (i−1)/2 outputs and the third and fourth each have (i+1)/2 inputs and (i+1)/2 outputs, the inputs of said first and third power distributors for microwave signals corresponding to respective inputs of said power distributor system and the outputs of said second and fourth power distributors for microwave signals corresponding to respective outputs of said power distributor system, the outputs of said first power distributor for microwave signals being connected to respective first inputs of said coupler elements and the outputs of said third power distributor for microwave signals, with the exception of one output, being connected to respective second inputs of said coupler elements, the inputs of said second power distributor for microwave signals being connected to respective first outputs of said coupler elements and the inputs of said fourth power distributor for microwave signals, with the exception of one input, being connected to respective second outputs of said coupler elements, said output of said third power distributor for microwave signals not connected to a coupler element being connected direct to said input of said fourth power distributor for microwave signals not connected to a coupler element;

wherein at least one of said first, second, third, and fourth power distributors for microwave signals is a power distributor for microwave signals as set forth in any of claims 1–2.

9. Power distributor system for microwave signals having j signal inputs and i signal outputs where $2 \leqq j \leqq i/2$ and i is even and greater than or equal to 4, and a set of coupler elements connecting said j inputs to said i outputs to distribute the power of the input signals to said i outputs according to any amplitude law, wherein said set of coupler elements comprises j coupler elements each having an input and two outputs, a first orthogonal power distributor for microwave signals having j inputs and j outputs, second and third orthogonal power distributors for microwave signals each having j inputs and i/2 outputs, the inputs of said first power distributor for microwave signals corresponding to respective inputs of said power distributor system, the outputs of said second and third power distributors for microwave signals corresponding to respective outputs of said power distributor system, the outputs of said first power distributor for microwave signals being connected to respective inputs of said coupler elements, the inputs of said second power distributor for microwave signals being connected to respective first outputs of said coupler elements, and the inputs of said third power distributor for microwave signals being connected to respective second outputs of said coupler elements;

wherein at least one of said first, second, and third power distributors for microwave signals is a power distributor for microwave signals as set forth in any of claims 1–6.

10. Power distributor system for microwave signals having j signal inputs and i signal outputs where $2 \leqq j \leqq (i-1)/2$ and where i is odd and greater than or equal to 5, and a set of coupler elements connecting said j inputs to said i outputs to distribute the power of the input signals to said i outputs in accordance with any amplitude law, wherein said set of coupler elements comprises j coupler elements each having an input and two orthogonal outputs, a first orthogonal power distributor for microwave signals having j inputs and j outputs, second and third power distributors for microwave signals, said second power distributor for microwave signals having j inputs and (i−1)/2 outputs, said third power distributor for microwave signals having j inputs and (i+1)/2 outputs, the inputs of said first power distributor for microwave signals corresponding to respective inputs of said power distributor system, the outputs of said second and third power distributors for microwave signals corresponding to respective outputs of said power distributor system, the output of said first power distributor for microwave signals being connected to respective inputs of said coupler elements, the inputs of said second power distributor for microwave signals being connected to respective first outputs of said coupler elements, and the inputs of said third power distributor for microwave signals being connected to respective second outputs of said coupler elements;

wherein at least one of said first, second, and third power distributors for microwave signals is a power distributor for microwave signals as set forth in any of claims 1–6.

11. Power distributor system for microwave signals having j signal inputs and i signal outputs where $i>j>i/2$ and where i is even and greater than or equal to 4, and a set of coupler elements connecting said j inputs to said i outputs to distribute the power of the input signals to said i outputs in accordance with any amplitude law, wherein said set of coupler elements comprises i/2 coupler elements each having two inputs and two outputs, a second and a fourth orthogonal power distributor for microwave signals each having i/2 inputs and i/2 outputs, a first and a third orthogonal power distributor for microwave signals respectively having k1, k2 inputs where $k1+k2=j$ and i/2 outputs, the inputs of said first and third power distributors for microwave signals corresponding to respective inputs of said power distributor system, the outputs of said second and fourth power distributors for microwave signals corresponding to respective outputs of said power distributor system, the outputs of said first power distributor for microwave signals being connected to respective first inputs of said coupler elements and the outputs of said third power distributor for microwave signals being connected to respective second inputs of said coupler elements, the inputs of said third power distributor for microwave signals being connected to respective first outputs of said coupler elements and the inputs of said fourth power distributor for microwave signals being connected to respective second outputs of said coupler elements wherein at least one of said first, second, third, and fourth power distributors for microwave signals is a power distributor for microwave signal as set forth in any of claims 1–6.

12. Power distributor system for microwave signals having j signal inputs and i signal outputs where $i>j>(i-1)/2$ and where i is odd and greater than or equal to 3, and a set of coupler elements connecting said j inputs to said i outputs to distribute the power of the input signals to said i outputs in accordance with any amplitude law, wherein said set of coupler elements comprises $(i-1)/2$ coupler elements each having two inputs and two outputs, a first and a second orthogonal power distributor for microwave signals having k, $(i-1)/2$ inputs (where $k\leqq(i-1)/2$) and $(i-1)/2$ outputs, respectively, a third and a fourth orthogonal power distributor for microwave signals, said third power distributor for microwave signals having k2 inputs (where $k1+k2=j$) and $(i+1)/2$ outputs, said fourth power distributor for microwave signals having $(i+1)/2$ inputs and $(i+1)/2$ outputs, the inputs of said first and third power distributors for microwave signals corresponding to respective inputs of said power distributor system, the outputs of said second and fourth power distributors for microwave signals corresponding to respective outputs of said power distributor system, the outputs of said first power distributor for microwave signals being connected to respective first inputs of said coupler elements and the outputs of said third power distributor for microwave signals, with the exception of one output, being connected to respective second inputs of said coupler elements, the inputs of said second power distributor for microwave signals being connected to respective first outputs of said coupler elements and the inputs of said fourth power distributor for microwave signals, with the exception of one input, being connected to respective second outputs of said coupler elements, said output of said third power distributor for microwave signals not connected to a coupler element being connected direct to said input of said fourth power distributor for microwave signals not connected to a coupler element;

wherein at least one of said first, second, third, and fourth power distributors for microwave signals is a power distributor for microwave signals as set forth in any of claims 1–6.

13. The power distributor for microwave signals as set forth in any of claims 1–6, wherein each of said coupler elements comprises a coupler.

14. The power distributor for microwave signals as set forth in any of claims 1–6, wherein at least one of said coupler elements comprises a coupler, and another of said coupler elements is selected from the set consisting of a coupler, a divider, parallel lines, and crossed lines.

* * * * *